US005485855A

United States Patent [19]

Shiraiwa et al.

[11] Patent Number: 5,485,855

[45] Date of Patent: Jan. 23, 1996

[54] INSTRUMENT FOR MEASURING BREAST SHAPE

[75] Inventors: Norinobu Shiraiwa, Shiga; Tatsuya Kusakabe, Kyoto, both of Japan

[73] Assignee: Wacoal Corp., Kyoto, Japan

[21] Appl. No.: 209,409

[22] Filed: Mar. 14, 1994

[30] Foreign Application Priority Data

Mar. 16, 1993 [JP] Japan ..... 5-011223 U

[51] Int. Cl.[6] ..... A61B 5/00

[52] U.S. Cl. ..... 128/774; 33/511

[58] Field of Search ..... 128/774; 33/511, 33/512, 514.1, 514.2

[56] References Cited

U.S. PATENT DOCUMENTS

| | | | |
|---|---|---|---|
| 456,286 | 7/1891 | Denzer | 33/514.2 X |
| 1,091,372 | 3/1914 | Mickelson | 33/512 X |
| 1,322,395 | 11/1919 | Baker | 33/512 |
| 1,508,811 | 9/1924 | Perkins-Kelly | 33/514.2 |
| 2,527,206 | 10/1950 | Amyot | 33/512 X |
| 4,279,260 | 7/1981 | Stump | 128/774 |

FOREIGN PATENT DOCUMENTS

| | | | |
|---|---|---|---|
| 106911 | 12/1963 | Netherlands | 33/512 |
| 22453 | of 1895 | United Kingdom | 33/511 |

*Primary Examiner*—Sam Rimell

*Attorney, Agent, or Firm*—Merchant, Gould, Smith, Edell, Welter & Schmidt

[57] ABSTRACT

An instrument for measuring breast shape having a base member with a substantially part-circular edge part which is to be applied along a base line of breast, a vertical tape measure for measuring a vertical length between a nipple and the verg's line, and a horizontal tape measure for measuring a horizontal length of the breast across the nipple.

19 Claims, 12 Drawing Sheets

INSTRUMENT FOR MEASURING BREAST SHAPE

FIELD OF THE INVENTION

This invention relates to an instrument for measuring breast shape, and especially relates to a simply configured instrument suitable for measuring the breast shape easily and applicable for selecting a cup size which is proper for the volume of the breasts of user, when an article of clothing having cups for supporting the breasts such as a brassiere, bra-slip, camisole, slops with sleeves, teddy, body shaper, bustier, leotard, swim suit and the like are produced or selected.

BACKGROUND OF THE INVENTION

Recently, many kinds of clothing for woman, such as underwear, day wear, foundation garments and so on, have a function for shaping the body line or making the proportions of the user more beautiful. Especially, in clothing having cups for supporting the breasts such as a brassiere, bra-slip, camisole, day wear with sleeves, teddy, three-in-one, body suit, bustier, leotard, swim suit and the like, it is necessary to make the cups fit to the shape of the user's breasts for giving a suitable fitting feeling.

Generally, the difference between the girth of the top bust and the girth of the under bust is used as an example of the standards for selecting a cup size. Hereupon, the top bust is the most protruded portion of the bust, and the under bust is a portion just below the bust. Corresponding to the difference between the girth of the top bust and the girth of the under bust, one cup-size is selected among A-cup, B-cup, C-cup, and so on. For example, in a Japanese standard, the A-cup is selected for a person whose girth difference is below 10 cm; the B-cup is selected for a person whose girth difference is above 10 cm and below 12.5 cm; and the C-cup is selected to a person whose girth difference is above 12.5 cm and below 15 cm.

However, the investigation has disclosed that about 40% of the users wear clothing having cups which fit the shapes or volumes of their breasts relatively well, but the remaining 60% or so of the users do not wear clothing having cups which properly fit the shapes or volumes of their breasts, when the cup-sizes are selected by the conventional method.

If a person has a lot of superfluous fresh on the back, but has small breasts, her top bust size will be measured large. On the other hand, if another person has the same top bust size as that of the former, but has a different breast size, the cup size of the latter will be different from that of the former. Therefore, a person, who has a large top bust size, does not necessarily use the large cup size. Thus, the above-mentioned conventional method does not consider the volume of the breasts.

SUMMARY OF THE INVENTION

This invention considers the volume of breasts. An object of the invention is to provide an instrument for measuring breast shape, by which the horizontal length of the breast across the nipple and the vertical length of the breast between the nipple and the verg's line (which is the circular arc under beneath of each breast) of the breast can be measured easily. Data with respect to the breast shape of the user, which is measured by the instrument of the invention, are used for selecting the cup size, and thereby the user can easily be provided with the clothing which has cups fitting the user's breast shapes.

An instrument for measuring breast shape in accordance with the invention comprises:

- a base member having a substantially half-circular edge part which is to be applied along the verg's line of the breast;
- a vertical tape measure having a predetermined graduation for measuring the vertical length of the breast between the nipple and the verg's line of the breast, an end thereof being fixed on the base member at a position in the vicinity of the lowest position of the substantially half-circular edge part;
- a horizontal tape measure having a predetermined graduation for measuring the horizontal length of the breast across the nipple, an end thereof being fixed on the base member at a position in the vicinity of one of the highest positions of the substantially half-circular edge part.

In the instrument for measuring breast shape configured above, it is preferable that a slit, to which the other free end of the horizontal tape measure is to be put, is provided on the base member at a position in the vicinity of the other highest position of the substantially half-circular edge part.

In the instrument for measuring breast shape configured above, it is preferable that at least one guide hook is provided on the base member at a position below the substantially half-circular edge part, by which the base member is to be hooked on such as a tape or a string.

Furthermore, in the instrument for measuring breast shape configured above, it is preferable that a stopper means, which has a width a little larger than the width of the horizontal tape measure, is provided on the base member at a position where the horizontal tape measure is to be fixed for restricting movement of the horizontal tape measure.

Furthermore, in the instrument for measuring breast shape configured above, it is preferable that a supplemental tape is provided on the horizontal tape measure from a point, which is a little closer to the free end of the horizontal tape measure from the center between the highest positions of the half-circular edge part of the base member, to a point in the vicinity of the other end of the horizontal tape measure; both ends of the supplemental tape are fixed on the horizontal tape measure; and the free end of the vertical tape measure is to be put into a loop formed by the horizontal tape measure and the supplemental tape.

Furthermore, in the instrument for measuring breast shape configured above, it is preferable that a stopper for preventing movement of the fixed end of the vertical tape measure is provided on the tape fixing part of the base member.

Another instrument for measuring breast shape in accordance with the invention comprises:

- a base member having a first member with a first substantially one-fourth circular edge part and a second member with a second substantially one-fourth circular edge part; the first and second members slidingly connected by a supporting member; the first and second substantially one-fourth circular edge part forming a substantially half-circular edge part which is to be applied along the verg's line of the breast;
- a vertical tape measure having a predetermined graduation for measuring the vertical length of the breast between the nipple and the verg's line of the breast, an end thereof being fixed on the base member at a position in the vicinity of the lowest position of the substantially half-circular edge part;

a horizontal tape measure having a predetermined graduation for measuring the horizontal length of the breast across the nipple, an end thereof being fixed on the base member at a position in the vicinity of one of the highest positions of the substantially half-circular edge part.

In the instrument for measuring breast shape configured above, it is preferable that a slit, to which the other free end of the horizontal tape measure is to be put, is provided on the base member at a position in the vicinity of the other highest position of the substantially half-circular edge part.

In the instrument for measuring breast shape configured above, it is preferable that at least one guide hook is provided on the base member at a position below the substantially half-circular edge part, by which the base member is to be hooked on such as a tape or a string.

Furthermore, in the instrument for measuring breast shape configured above, it is preferable that a stopper means, which has a width a little larger than the width of the horizontal tape measure, is provided on the base member at a position where the horizontal tape measure is to be fixed for restricting movement of the horizontal tape measure.

Furthermore, in the instrument for measuring breast shape configured above, it is preferable that a supplemental tape is provided on the horizontal tape measure from a point, which is a little closer to the free end of the horizontal tape measure from the center between the highest positions of the half-circular edge part of the base member, to a point in the vicinity of the other end of the horizontal tape measure; both ends of the supplemental tape are fixed on the horizontal tape measure; and a free end of the vertical tape measure is to be put into a loop formed by the horizontal tape measure and the supplemental tape.

Furthermore, in the instrument for measuring breast shape configured above, it is preferable that a stopper for preventing movement of the fixed end of the vertical tape measure is provided on the tape fixing part of the base member.

Still another instrument for measuring breast shape in accordance with the invention comprises:

a base member having a first member with a first substantially one-fourth circular edge part, a second member with a second substantially one-fourth circular edge part and a holder for connecting the first and second members the first and second substantially one-fourth circular edge part forming a substantially half-circular edge part which is to be applied along the verg's line of the breast; the holder having a pair of guide rails horizontally protruded therefrom; and the first and second members respectively having a guide groove to be engaged with the guide rails;

a vertical tape measure having a predetermined graduation for measuring the vertical length of the breast between the nipple and the verg's line of the breast, an end thereof being fixed on the base member at a position in the vicinity of the lowest position of the substantially half-circular edge part;

a horizontal tape measure having a predetermined graduation for measuring the horizontal length of breast across the nipple, an end thereof being fixed on the base member at a position in the vicinity of one of the highest positions of the substantially half-circular edge part.

Furthermore, in the instrument for measuring breast shape configured above, it is preferable that at least one convex stopper is provided on the guide rails, and at least one convex stopper is provided on a surface of the guide grooves.

In the instrument for measuring breast shape described above, it is preferable that a slit, to which the other free end of the horizontal tape measure is to be put, is provided on the base member at a position in the vicinity of the other highest position of the substantially half-circular edge part.

In the instrument for measuring breast shape configured above, it is preferable that at least one guide hook is provided on the base member at a position below the substantially half-circular edge part, by which the base member is to be hooked on such as a tape or a string.

Furthermore, in the instrument for measuring breast shape configured above, it is preferable that a stopper means, which has a width a little larger than the width of the horizontal tape measure, is provided on the base member at a position where the horizontal tape measure is to be fixed for restricting movement of the horizontal tape measure.

Furthermore, in the instrument for measuring breast shape configured above, it is preferable that a supplemental tape is provided on the horizontal tape measure from a point, which is a little closer to the free end of the horizontal tape measure from the center between the highest positions of the half-circular edge part of the base member, to a point in the vicinity of the other end of the horizontal tape measure; both ends of the supplemental tape are fixed on the horizontal tape measure; and a free end of the vertical tape measure is to be put into a loop formed by the horizontal tape measure and the supplemental tape.

Furthermore, in the instrument for measuring breast shape configured above, it is preferable that a stopper for preventing movement of the fixed end of the vertical tape measure is provided on the tape fixing part of the base member.

In the instrument for measuring breast shape in accordance with the invention, the base member has the substantially half-circular edge part which is to be applied along the base line of the breast. One of the highest position of the half-circular edge part corresponds to a crossing point of the verg's line of the breast and a horizontal line across the nipple in the side of the human body. The other highest position of the substantially half-circular edge part corresponds to a crossing point of the verg's line of the breast and the horizontal line across the nipple in the center of the human body. The lowest position of the substantially half-circular edge part corresponds to the lowest point of the base line of the breast.

The vertical tape measure is used for measuring the vertical length of the breast between the nipple and the lowest point of the verg's line of the breast. The horizontal tape measure is used for measuring the horizontal length of the breast across the nipple. Thus, the instrument can measure the horizontal length and the vertical length of the breast by applying the substantially half-circular edge part along the verg's line of the breast. From the sum of the measured value of the horizontal length and the vertical length of the breast and the size of the verg's line of the breast (size of the substantially half-circular edge part of the base member), the cup size and the verg's line of the cup of clothing such as a brassiere can easily be selected.

The shape of the instrument, especially, the shape of the base member is relatively flat and simple. Furthermore, the base member, the vertical and horizontal tape measures can be made by, for example, a plastic material, or the like, so that they are strong, light and inexpensive. Therefore, the instrument for measuring breast shape in accordance with the invention can be mailed in an envelope with a catalogue for mail business. Furthermore, it can be provided at a shop front or in a fitting room, or it can be distributed to the user. Thus, the user can measure her breast shape by herself, and she can select clothing having the cups fitting to her breast shape.

In the above-mentioned instrument for measuring breast shape, the free end of the horizontal tape measure is preferable to be put into the slit. Thus, the free end of the horizontal tape measure can be maintained at a predetermined position easily.

In the instrument for measuring breast shape, at least one guide hook is preferably provided in the lower part of the base member to be hooked on such as a string or a tape. Thus, in case of measuring the horizontal length and the vertical length of the breast by applying the instrument to the verg's line of the breast from the lower side of the breast, the guide hook can be hooked firmly on such as the string or the tape, and the string or the tape can be wound around the user's under bust. As a result, the instrument can be held at a predetermined position firmly, and the measurement can be executed without holding the base member by hand, and the measuring operation can be made easy. Furthermore, a tape measure having a graduation can be used as the string or the tape, so that the girth of the under bust can be measured at the same time.

Furthermore, in the instrument for measuring breast shape in accordance with the invention, the base member is preferably to be divided into the first and second members. The first member has a substantially one-fourth circular edge part which corresponds to the verg's line of the breast from the lowest position of the breast to the side of the human body, and the second member has a substantially one-fourth circular edge part which corresponds to the verg's line of the breast from the lowest position of the breast to the center of the human body. Furthermore, the first and second parts are preferably slidingly connected by a supporting member in the vicinity of the lowest position of the base member. Thus, the instrument can be used in a manner so that the first and second members are slid on the guide rails for making the span between the first and second members narrow or wide responding to the size of the breasts to be measured. As a result, it is not necessary to prepare some kinds of the instruments having different sizes of the substantially half-circular edge part of the base member.

Furthermore, in the above-mentioned instrument for measuring breast shape, the stopper means such as a pair of protrusions are preferably provided at an interval wider than the width of the fixing end of the horizontal tape measure at a portion of the base member where the fixing end of the horizontal tape measure is to be fixed. Thus, it can prevent slipping of the fixing end of the horizontal tape measure out of the base member, or it can prevent the dropping of the fixing end of the second tape measure down to the bottom of the base member. Furthermore, since the width of the stopper is made to be wider than the width of the fixed end of the horizontal tape measure, the position of the fixed end of the horizontal tape measure can be adjusted in a range of the width of the stopper. As a result, the fixing end of the horizontal tape measure can be adjusted at a suitable position responding to the position of the user's top bust.

Furthermore, in the above-mentioned instrument for measuring breast shape, the supplemental tape is preferably provided on the horizontal tape measure for making the loop formed by the horizontal tape measure and the supplemental tape. Thus, the free end of the vertical tape measure can be put in the loop formed between the horizontal tape measure and the supplemental tape, so that the loop can serve as a guide for positioning the free end of the vertical tape measure at a predetermined position. As a result, the measurement can be executed easily.

Furthermore, in the above-mentioned instrument for measuring breast shape, the stopper for preventing movement of the fixing end of the vertical tape measure is preferably provided on the tape fixing part of the holder. Thus, the movement of the fixing end of the vertical tape measure can be prevented. As a result, the measurement can be made precise.

Furthermore, in the above-mentioned instrument for measuring breast shape, the holder preferably has the protruded part vertically protruded from the fixing part and guide rails horizontally protruded from the protruded part, and the first and second parts respectively have guide grooves to be engaged with the guide rails. Thus, the size of the substantially half-circular edge part formed by the first and second members can be slidingly changed for fitting to the size of the breast of the user. Furthermore, the first and second members, the holders and the like can be disassembled. As a result, the instrument can be mailed to the user with the catalogue and the like.

Furthermore, in the above-mentioned instrument for measuring breast shape, at least one convex stopper is preferably to be provided on the guide rails, and at least one convex stopper is provided on a surface of the guide grooves. Thus, the first and/or second member(s) can be prevented from slipping out of the holder.

DETAILED DESCRIPTION OF THE INVENTION

Figure 1:
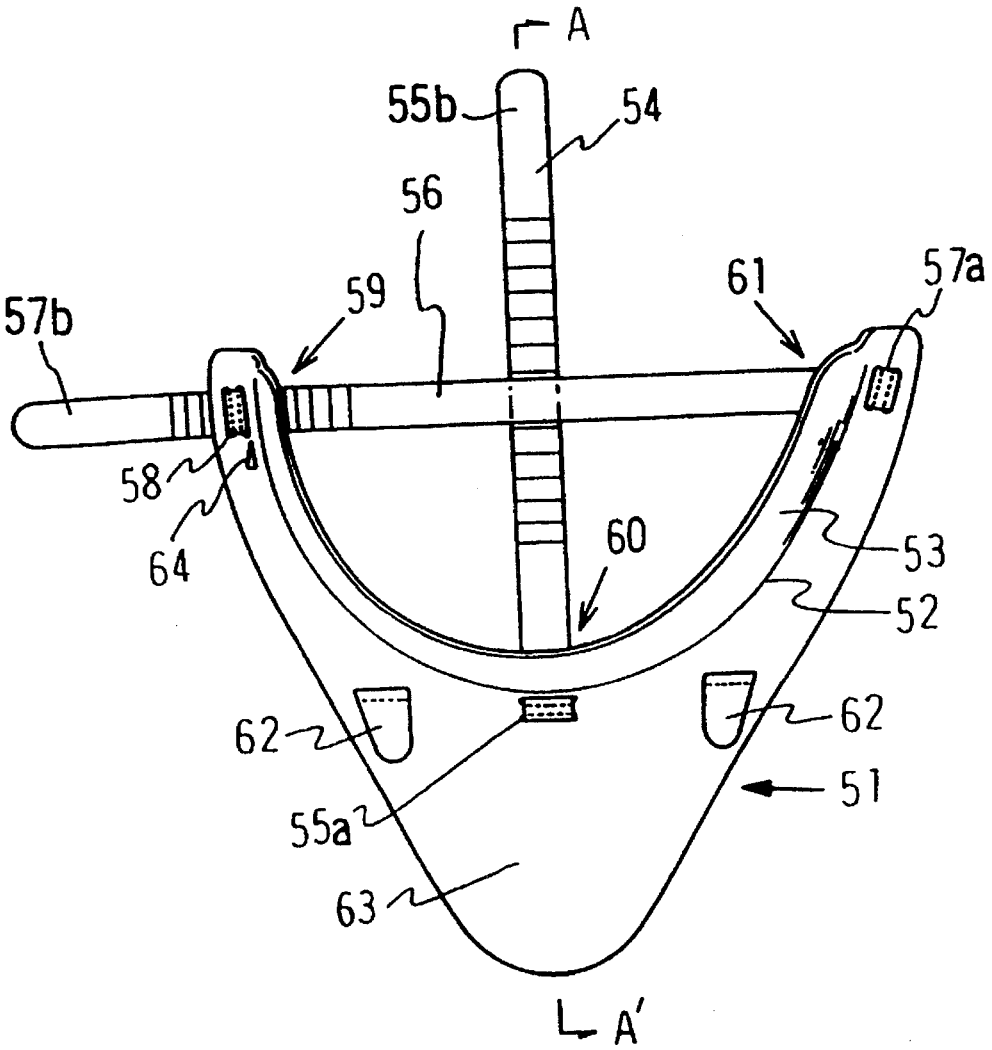
FIG. 1 is a front view showing an instrument for measuring breast shape in accordance with a first embodiment of the invention.
Figure 2:
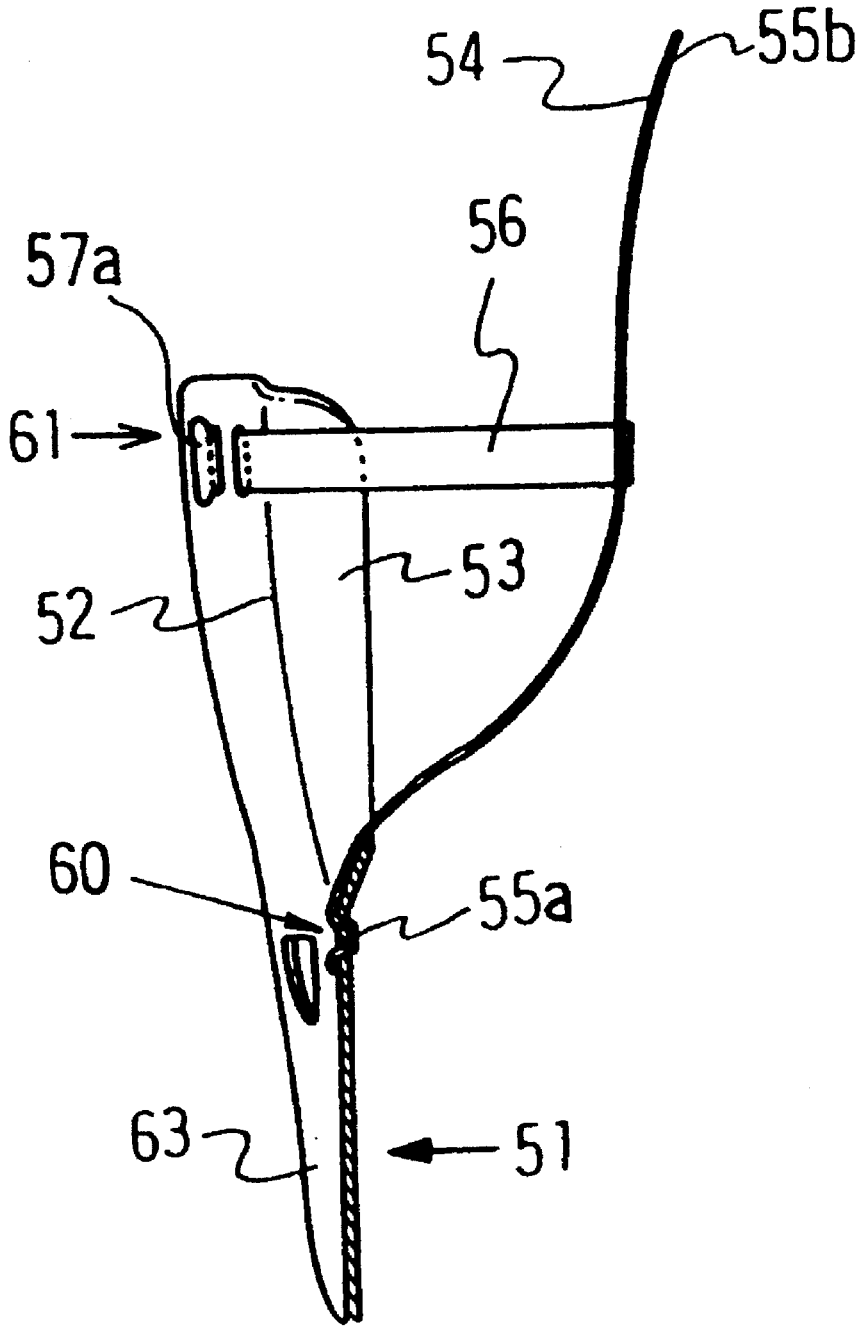
FIG. 2 is a sectional side view along line A—A in FIG. 1.
Figure 3:
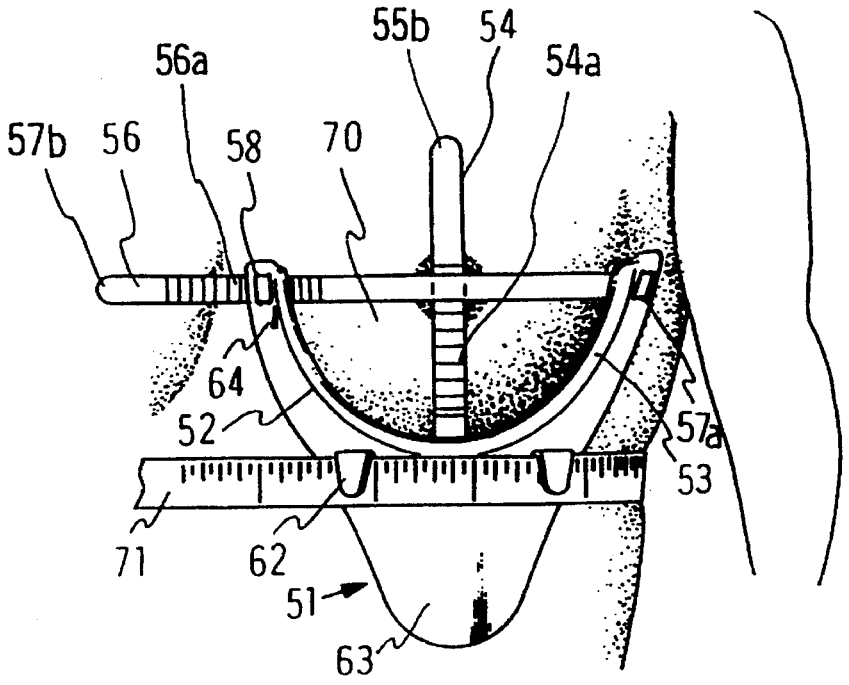
FIG. 3 is a front view showing a measurement of a breast shape of a female body using the instrument according to the invention.
Figure 4:
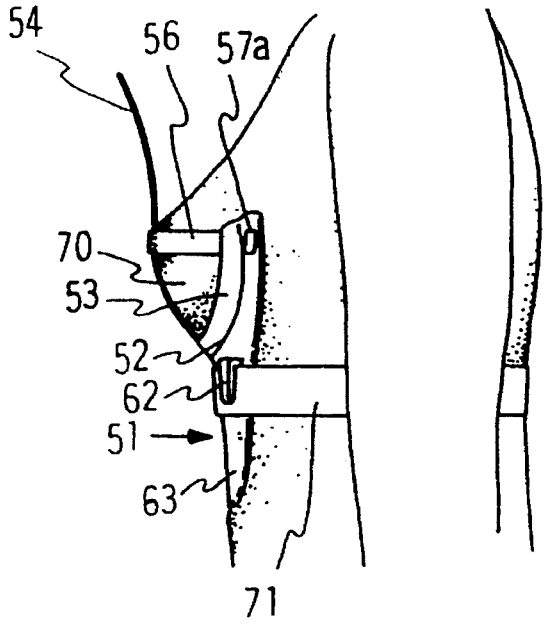
FIG. 4 is a side view of the measurement shown in FIG. 3.

A first preferred embodiment of an instrument for measuring breast shape in accordance with the invention is described referring to FIGS. 1, 2, 3 and 4. FIG. 1 is a front view of an instrument for measuring breast shape of the first embodiment. FIG. 2 is a sectional side view along line A—A in FIG. 1. FIG. 3 is a front view showing a measurement of a breast shape of a female body using the instrument according to the invention. FIG. 4 is a side view of the measurement shown in FIG. 3.

As shown in FIGS. 1 to 4, the instrument for measuring breast shape of the first embodiment comprises a base member 51, a vertical tape measure 54 and a horizontal tape measure 56. The base member 51 has a substantially half-circular edge part 52 which is to be put along the base line of a breast of a female body. Furthermore, the base member 51 has a breast supporting guide 53 provided along the substantially half-circular edge part 52 which protrudes like a visor. An end 55*a* of the vertical tape measure 54 is fixed on the base member 51 in the vicinity of the lowest position 60 of the half-circular edge part 52. The lowest position 60 corresponds to the lowest position of the verg's line of the breast. The verg's line is the circular arc under beneath of each breast. The vertical tape measure 54 is to be used for measuring the vertical length of the breast between the nipple and the lowest position of the verg's line of the breast (hereinafter abbreviated as "vertical length of the breast"). An end 57*a* of the horizontal tape measure 56 is fixed on the base member 51 in the vicinity of the first highest position 61 of the base member 51. The first highest position 61 corresponds to the highest position of the verg's line of the breast at the side of the human body. The horizontal tape measure 56 is to be used for measuring the horizontal length of the breast across the nipple (herein after abbreviated as "horizontal length of the breast"). A slit 58 is provided on the base member 51 in the vicinity of the second highest position 59 of the base member 51. The second highest position 59 corresponds to the highest position of the verg's line of the breast in the vicinity of the center of the bust of the female body. A free end 57*b* of the horizontal tape measure 56 is to be put in the slit 58. A pair of guide hooks 62 are provided on the base member 51 at positions below the breast supporting guide 53. In this embodiment, each guide hook 62 has a hook shape by which the instrument for measuring the breast shape is to be hooked on such as a string or a tape. The base member 51 further has a holder 63 by which the instrument is manually handled. A mark 64 is provided on the base member 51 in the vicinity of the second highest position 59 or the slit 58 for showing the position which is to be put on the center of the bust of the female body.

While it is not necessarily always the case, generally the length of a first member of the substantially half-circular edge part 52, which is from the lowest position 60 to the first highest position 61, is a little longer than that of a second member, which is from the lowest position 60 to the second highest position 59. The curvature of the first member is generally larger than that of the second member. Thus, instruments intended for use with the right breast or the left breast can be prepared, and the mark 64 is provided on the base member 51 to distinguish between the instruments for the right breast and for the left breast. For example, the instrument shown in FIG. 1 is for the left breast, since the mark 64 is shown in the left hand in the figure.

As shown in FIGS. 3 and 4, the instrument is put on the breast 70 of a female body. In this case, the guide hooks 62 of the base member 51 are hooked on a tape measure 71. The vertical and horizontal tape measures 54 and 56 respectively have graduations 54*a* and 56*a*. Units of the graduations 54*a* and 56*a* can be freely graduated. The graduations 54*a* and 56*a* graduated by an original unit such as A, B, C . . . , and the like can be acceptable, as long as they can measure the length. As is obvious from FIG. 4, it is preferable that the base member 51 has a shape in each section along the curve of the female body.

Figure 5:
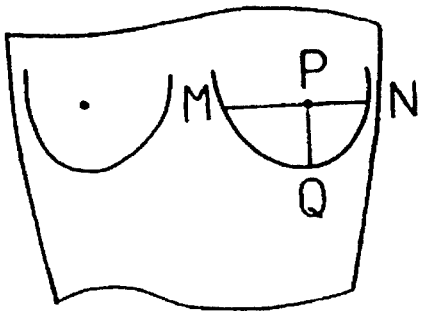
FIG. 5 is a schematic front view showing the bust of a female body.
Figure 6:
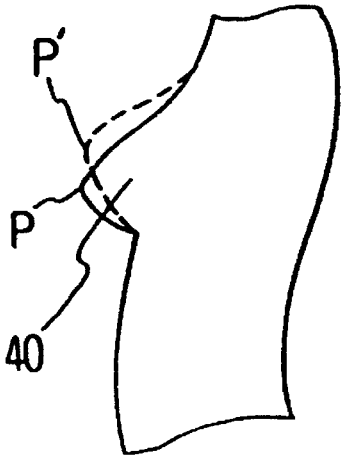
FIG. 6 is a side view showing the bust of the female body.

The method for measuring the horizontal length of the breast and the vertical length of the breast by using the above-mentioned instrument is described further referring to FIGS. 5 and 6.

FIG. 5 is a schematic front view showing a bust of a female body. In view of the left breast, the most protruded point (top bust) is designated by the letter P, the most outer point of the verg's line of the breast is designated by numeral N, the most inner point of the verg's line of the breast is designated by the letter M, and the lowest point of the verg's line of the breast is designated by the letter Q. A length from the point M to the point N through the point P corresponds to the horizontal length of the breast across the nipple. A length from the point P to the point Q corresponds to the vertical length of the breast between the nipple and the lowest position of the verg's line of the breast.

For measuring the horizontal length and the vertical length of the breast, the substantially half-circular edge part 52 of the base member 51 of the instrument shown in FIG. 1 is put along the verg's line of the breast from the point M to the point N through the point Q in FIG. 5. At this time, it is preferable to select an instrument from several instruments respectively having a different size of the base member 51, which has a substantially half-circular edge part 52 a little smaller than the verg's line of the breast of the user. FIGS. 3 and 4 show this case. As shown in FIGS. 3 and 4, the guide hooks 62 are engaged with the tape measure 71; the tape measure 71 is wound around the body to the back; and the tape measure 71 is fixed by a catch, a hook, a fastener, an adhesive tape or binding. Thus, the base member 51 is firmly fixed on the body without holding it by hand.

As shown in FIG. 4, the vertical tape measure 54 is pulled along the bulge of the breast from the point Q to the point P shown in FIG. 5. The horizontal tape measure 56 is also pulled along the bulge of the breast from the point N to the point M through the point P shown in FIG. 5. Furthermore, the free end 57*b* of the horizontal tape measure 56 is put into the slit 58 in order to fix the horizontal tape measure 56. And then, the horizontal length and the vertical length of the breast will be measured.

FIG. 6 is a side view showing the bust of the female body. In FIG. 6, numeral 40 designates a breast and the letter P designates the most protruded point of the breast (top bust). In the instrument of this invention, it is possible for the user to measure her breast shape with the breast at a position which the user prefers. For example, when the user wishes to have the position of the top bust P of the breast at a position P' shown by dotted line in FIG. 6, the breast is pulled up to the position which the user wishes by the vertical tape measure 54, and the value shown by the graduation of the vertical tape measure 54 is read for this position. Thus, the instrument of this invention is effective to select the cup size by which the shape of the breast of the user can be amended to the proportion that she wishes.

The sum of the values of the horizontal length and the vertical length of the breast, which are measured by the above-mentioned method, correspond to the volume of a cup of the products. The verg's line of the cup can be decided by the size of the substantially half-circular edge part 52 of the base member 51, so that the cup size which fits to the volume of the user's breast can easily be selected.

In the above-mentioned instrument for measuring breast shape in accordance with the invention shown in FIGS. 1 to 4, it is preferable that plural kinds, for example, six to eight kinds of the base member 51, each having a different size of the substantially half-circular edge part 52 is prepared, since generally the users have a different size of the breast volume, or the different verg's line of the breast along the points M to N through Q. The user can select the instrument which has the substantially half-circular edge part 52 which corresponds but to her verg's line of the breast.

Figure 7:
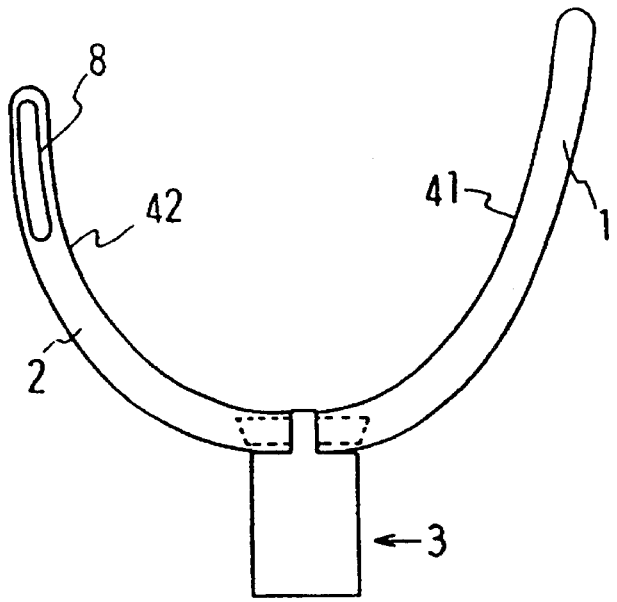
FIG. 7 is a front view of a base member of the instrument in accordance with a second embodiment of the invention.
Figure 8:
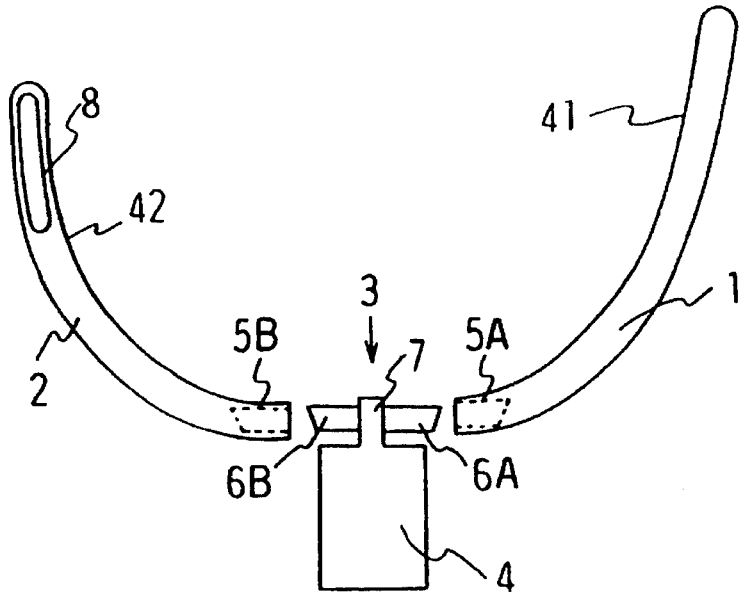
FIG. 8 is a front view showing the disassembled base member shown in FIG. 7.
Figure 9:
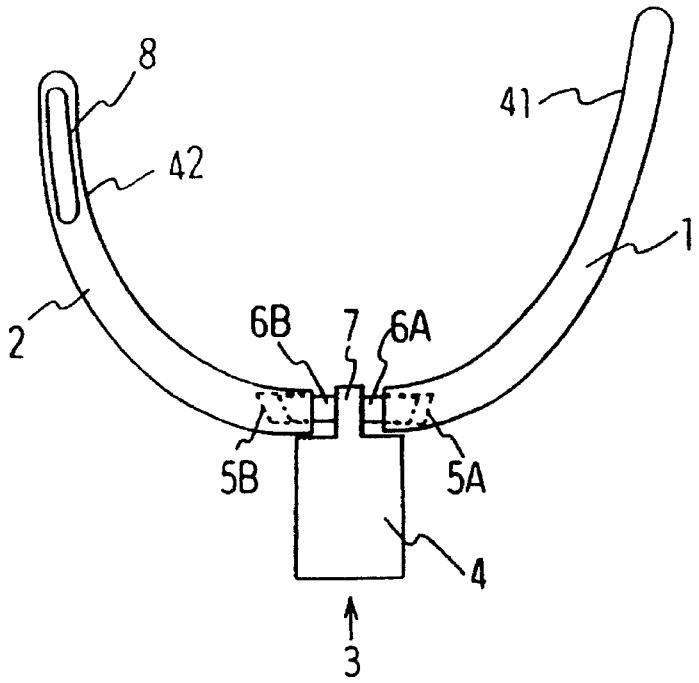
FIG. 9 is a front view showing the assembly of the base member.

A second preferred embodiment of the instrument for measuring the breast shape in accordance with the invention is described referring to FIGS. 7, 8 and 9. In the second embodiment, the base member can be adjusted so that the size of the substantially half-circular edge part 52 responding to the size of the breast of the user.

FIG. 7 is a front view of a base member of the instrument in accordance with the second embodiment, to which the vertical and horizontal tape measures are not fixed yet. As shown in FIG. 7, the base member comprises first and second members 1 and 2, and a holder 3. The first member 1 has a substantially one-fourth circular edge part 41 from the lowest position to the highest position at the side part of the verg's line of the breast. The second member 2 has a substantially one-fourth circular edge part 42 from the lowest position to the highest position in the center of the verg's line of the breast.

FIG. 8 is a front view showing the disassembled base member shown in FIG. 7. FIG. 9 is a front view showing the assembly of the base member. In these figures, elements designated by the same numeral are the same as shown in FIG. 7, so that the explanations of them are omitted. In the second embodiment shown in FIGS. 7 to 9, a slit 8 having a dimension to accept a free end of a second tape measure is provided in the vicinity of the top end of the second member 2.

The holder 3 has a tape fixing part 4 which serves as a handle which the user grasps in the measurement of the breast shape, a protruded part 7 from the upside of the tape fixing part 4, and guide rails 6A and 6B which are respectively protruded in opposite side from the protruded part 7 to which the first and second members 1 and 2 are connected. The first and second member 1 and 2 have guide grooves 5A and 5B respectively, which can be engaged with the guide rails 6A and 6B. Thus, the first and second members 1 and 2 are slidingly engaged with the guide rails 6A and 6B. Accordingly, when the breast shape is measured by the instrument shown in FIGS. 7 to 9, a span between the first and second member 1 and 2 can be adjusted for fitting the size of the breast of the user corresponding to the horizontal length of the breast from the side to the center of the human body by sliding the first and/or second member 1 and/or 2 on the guide rails 6*a* and 6B.

Figure 10:
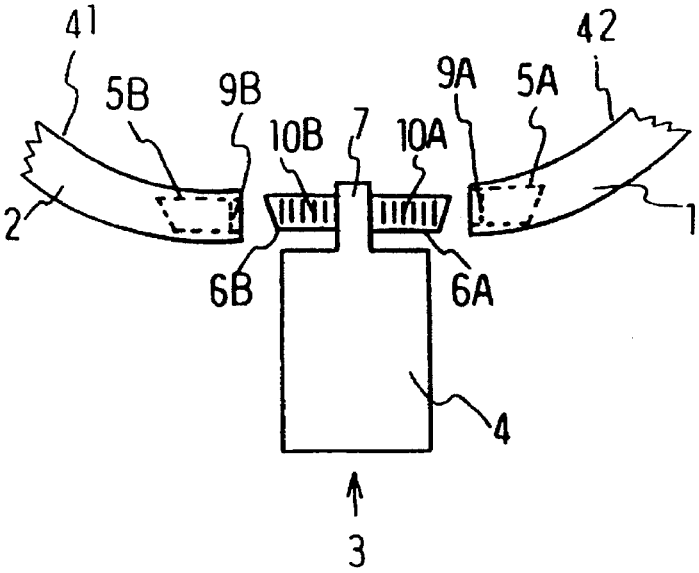
FIG. 10 is an exploded front view showing a detailed configuration of the base member in accordance with a third embodiment of the invention.

A third preferred embodiment of the instrument for measuring breast shape in accordance with the invention in described referring to FIG. 10. FIG. 10 is an exploded front view showing a detailed configuration of the base member of the third embodiment. The elements designated by the same numerals in FIG. 8 are substantially the same as those in FIG. 8, so that the explanations of them are omitted. In comparison with FIG. 8, the base member of the third embodiment shown in FIG. 10 has convex stoppers 10A and 10B on the surfaces of the guide rails 6A and 6B across the guide rails 6A and 6B. Furthermore, the first and second members 1 and 2 with the part-circular edge part respectively have convex stoppers 9A and 9B on the surfaces of the guide grooves 5A and 5B across the guide grooves 5A and 5B.

Providing one of the stoppers 10A and 10B respectively in the vicinity of the top ends of the guide rails 6A and 6B can prevent the first and/or second member(s) 1 and/or 2 from dropping off the guide rail(s) 6A and/or 6B during the actual measurement. Providing a plurality of the stoppers 10A and 10B on the guide rails 6A and 6B allows the maintenance of the span between the first member 1 and the second member 2, which is slidingly adjustable at the position best responding to the size of breast of the user. Thus, this effectively prevents that changes in the span between the first and second members during the measurement.

In these cases, it is unreasonable to measure the various kinds of breasts by only one set of the first and second members 1 and 2 having a fixed length and curvature of the substantially half-circular edge part. Thus, it is preferable that plural sets, for example, two sets of the first and second members 1 and 2, which can be applicable to from a small size of the breast to a medium size of the breast and from a medium size of the breast to a large size of the breast, are prepared.

Figure 11:
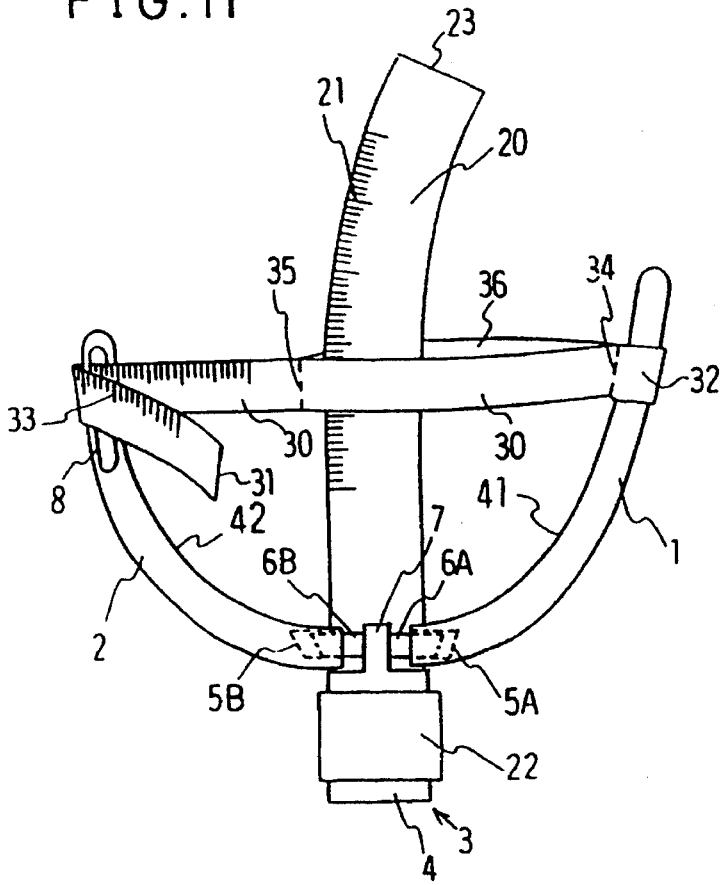
FIG. 11 is a front view showing a configuration of an instrument in accordance with a fourth embodiment of the invention.

A fourth preferred embodiment of an instrument for measuring breast shape in accordance with the invention is described referring to FIG. 11. FIG. 11 is a front view showing the configuration of the instrument of the fourth embodiment. The instrument shown in FIG. 11 has a vertical tape measure 23 for measuring the vertical length of the breast and a horizontal tape measure 30 for measuring the horizontal length of the breast over the base member shown in FIGS. 7 to 10. The elements designated by the same numerals in the FIGS. 7 to 10 are substantially the same as those, so that the explanations of them are omitted. As shown in FIG. 11, the horizontal tape measure 30 for measuring the horizontal length of the breast has a graduation 33. A fixed end 32 of the horizontal tape measure 30 is fixed on the first member 1. The end 32 of the horizontal tape measure 30 is twisted around the first member 1 and sewn on a sewing line 34. The method for fixing the horizontal tape measure 30 is not restricted by the above-mentioned way, and another way such as a method shown in FIG. 1 or the like can be applicable as long as the method can attain the object of the invention. In the measurement, a free end 31 is to be put into a slit 8 which is provided in the vicinity of a top end of the second member 2. Thus the measurement of the horizontal length of the breast can be executed easily. In the embodiment shown in FIG. 11, a supplemental tape 36 is provided on the horizontal tape measure 30 from a point, which is slightly forward the side of free end 31 with respect to the center of a line between the top ends of the first and second members 1 and 2, to a point in the vicinity of the fixed end 32. The supplemental tape 36 is fixed on the horizontal tape measure 30 on the sewing lines 34 and 35. The method for fixing the supplemental tape 36 on the horizontal tape measure is not restricted by the above-mentioned embodiment. By providing the supplemental tape 36, a free end 23 of the vertical tape measure 20 can be put into the loop formed by the horizontal tape measure 36 and the supplemental tape 36 in the measurement of the vertical length of the breast. The loop formed between the horizontal tape measure 36 and the supplemental tape 30 serves as a guide for positioning the free end 23 of the vertical tape measure 20 at a predetermined position for making the measurement of the shape of the breast easily.

A graduation 21 is provided at a predetermined position of the vertical tape measure 20 for measuring the vertical length of the breast. A fixed end of the vertical tape measure 20 is fixed on a tape fixing part 4 of a holder 3. Numeral 22 designates a fixing end of the vertical tape measure 20 in FIG. 11.

Figure 12:
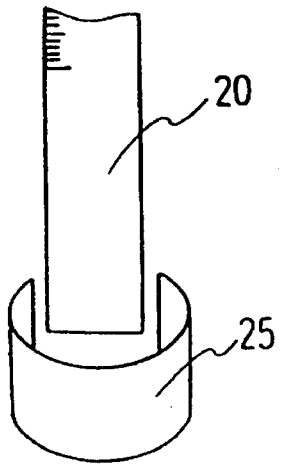
FIG. 12 is a perspective view showing a process for forming a fixing end 22 of a vertical tape measure 20.
Figure 13:
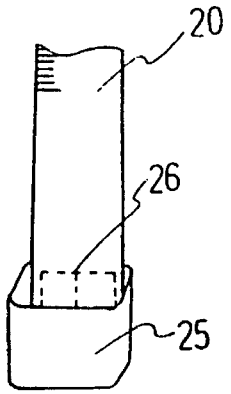
FIG. 13 is a perspective view showing a process for forming the fixing end 22 of the vertical tape measure 20.
Figure 14:
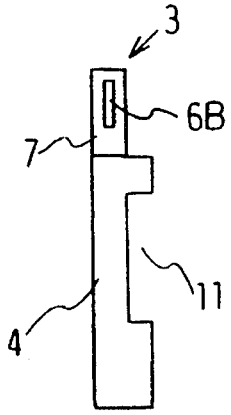
FIG. 14 is a right side view of a holder 3 shown in FIG. 8.
Figure 15:
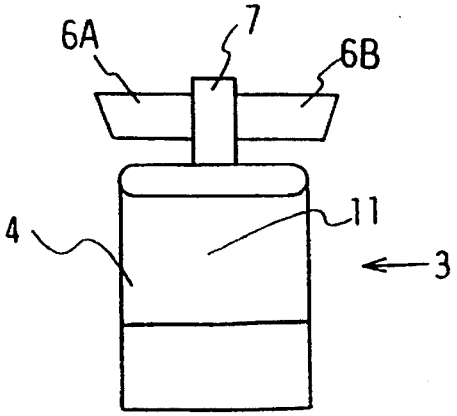
FIG. 15 is a back view showing the opposite side of the holder 3 shown in FIG. 8.

The method for fixing the vertical tape measure 20 on the tape fixing part 4 is described referring to FIGS. 12 to 15. However, the method is not restricted by this embodiment. FIGS. 12 and 13 respectively show the processes for forming the fixing end 22 of the vertical tape measure. FIG. 14 is a right side view of the holder 3. FIG. 15 is a back view showing the holder 3 in the opposite side of FIG. 8.

The elements in FIGS. 14 and 15 which are designated by the same numerals in FIGS. 7 to 11 are substantially the same as those, so that the explanations of them are omitted. The holder 3 shown in FIGS. 14 and 15 are especially preferable embodiments having a stopper for preventing the movement of the fixing end 22 of the vertical tape measure on the tape fixing part 4. In FIGS. 14 and 15, cuttings 11 are formed as a stopper for preventing the movement of the fixing end 22 of the vertical tape measure 20 on the tape fixing part 4.

As shown in FIG. 12, the vertical tape measure 20 and a tape 25 for fixing the end of the vertical tape measure are prepared. As shown in FIG. 13, the tape 25 is positioned for enclosing the tape fixing part 4, and the vertical tape measure 20 and the tape 25 are fixed by the sewing line 26. Instead of the sewing, an adhesive can be used for adhering the vertical tape measure 20 and the tape 25. In the latter case, the width of the tape 25 is made substantially the same as, but a little narrower than, the width of the cutting 11. Thus, a part of the fixing end 22 which is formed by the tape 25 is engaged with the cutting 11, so that the cutting 11 serves as a a stopper for preventing the movement of the fixing end 22 of the vertical tape measure 20.

Figure 16:
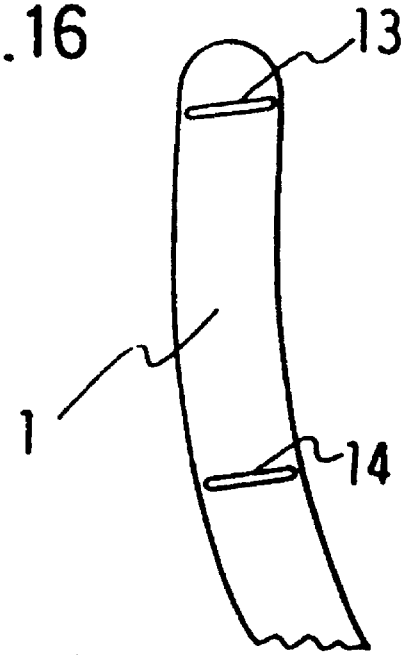
FIG. 16 is a back view of a first member 1 having a circular edge part in accordance with a fifth embodiment of the invention.
Figure 17:
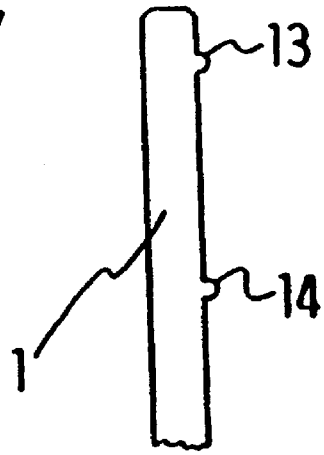
FIG. 17 is a right side view of the first member 1.

A fifth preferred embodiment of the instrument for measuring the breast shape in accordance with the invention is described referring to FIGS. 16 and 17. FIG. 16 is a back view of the first member 1 having a substantially circular edge part shown in FIG. 8. FIG. 17 is a right side view of the first member 1. In this embodiment, stoppers 13 and 14 for fixing the horizontal tape measure are provided on the first member 1.

In this embodiment, the stoppers 13 and 14 are convexly provided across a horizontal direction of the first member 1. The stoppers 13 and 14 prevent the slipping out of the fixing end 32 of the horizontal tape measure 30 from the top end of the first member 1, or they prevent the sliding down to the lower part from the top end of the first member 1. It is preferable that the distance between the stoppers 13 and 14 is to be made wider than the width of the fixing end 32 of the horizontal tape measure 30. When the distance between the stoppers 13 and 14 are selected in a predetermined value, the position of the fixing end 32 can be adjusted in a distance between the stoppers 13 and 14. Thus, the position of the fixing end 32 of the horizontal tape measure 30 can be adjusted at a predetermined preferable position responding to the top bust position which is the most protruded point of the breast.

The method for measuring the horizontal length and the vertical length of the breast by using the slide type instrument is described. The method is substantially the same as the method using the instrument shown in FIG. 1.

For measuring the horizontal length and vertical length of the breast, the instrument of the invention, for example, shown in FIG. 11 is put along the part-circular verg's line of the breast along the points M to N through Q shown in FIG. 5. At this time, the distance between the first and second members 1 and 2 should be adjusted to position the slit 8 of the second member 2 outward of the point M, to position the holder 3 just below the point Q, and to position the fixed end 32 of the horizontal tape measure 30 outward the point N, to respond to the size of the breast or position of the top bust. It is preferable that the distance between the first and second members 1 and 2 are made a little narrower than the size of the verg's line of the breast of the user whose breasts shapes are to be measured. Furthermore, it is preferable that the position of the fixed end 32 of the horizontal tape measure 30 on the first member 1 is to be adjusted to respond to the position of the top bust, if necessary. After that, the vertical tape measure 20 is adjusted to be positioned on the line P-Q in FIG. 5, and the horizontal tape measure 30 is adjusted to be positioned on the line M-P-N in FIG. 5. Thus, the horizontal length and the vertical length of breast are measured. In case of expanding the distance between the first and second members 1 and 2, the expanded distance or the distance between the top ends of the substantially one-fourth circular edge part 41 of the first member 1 and the top end of the substantially one-fourth circular edge part 42 of the second member 2 are measured by, for example, the vertical tape measure 20. From these measured data, the base line of brassiere cup can be decided. In case of using the instruments having the stoppers 9A, 9B, 10A, 10B shown in FIG. 10 is used, numerals such as 1, 2, 3, 4, . . . are serially provided on the protruded part of the stoppers 10A, 10B, and the like, from the nearest one. Thus, the size of the verg's line of the breast can be known from the information where the first and second members 1 and 2 are expanded.

In the above-mentioned measurement, it is preferable that the free end 31 of the horizontal tape measure 30 is put into the slit 8 which is provided in the vicinity of the top end of the second member 2, so that the measurement of the horizontal length of the breast can be made easily. Similarly, it is preferable that the free end 21 of the vertical tape measure 20 is to be put in the loop formed by the horizontal tape measure 30 and the supplemental tape 36, so that the vertical length of breast can be measured easily.

Figure 18:
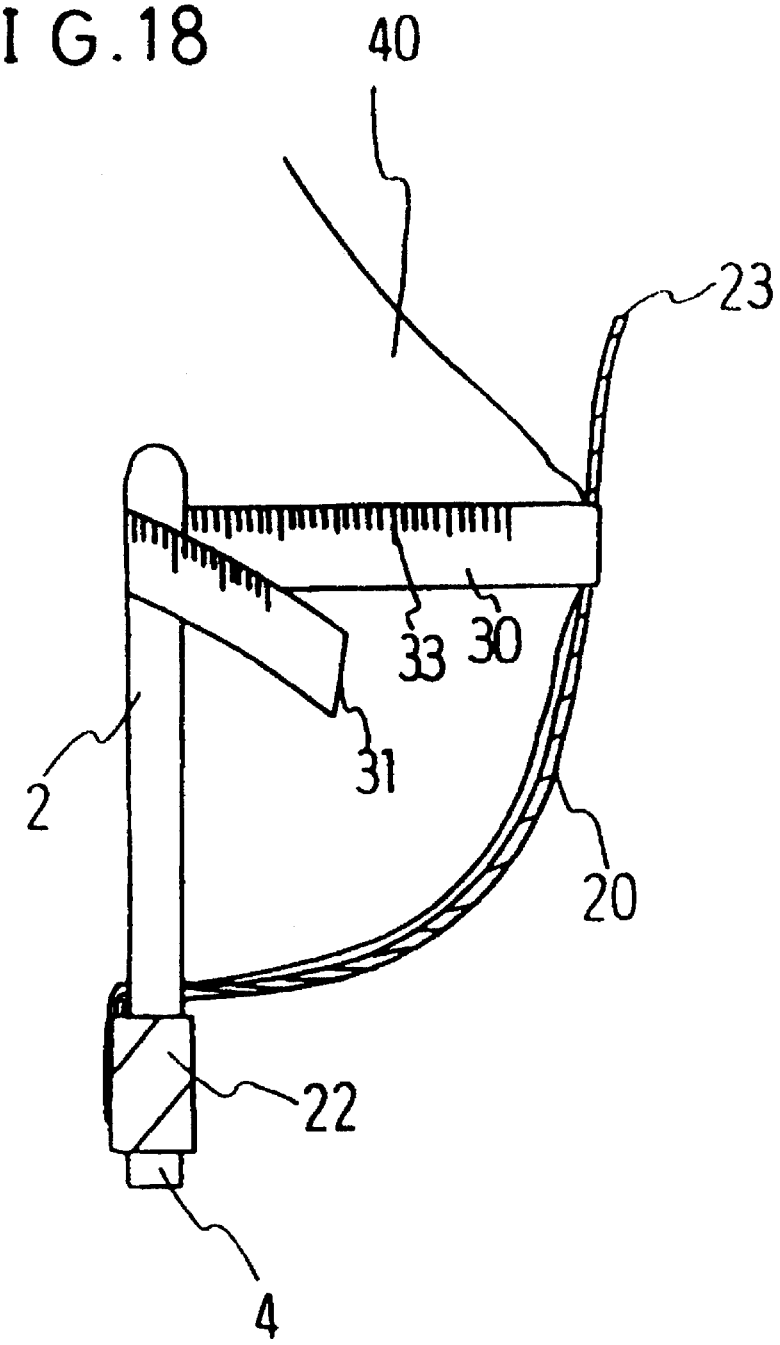
FIG. 18 is a side view showing a measurement of the left breast by using the instrument.

A measurement of the left breast by using the above-mentioned instrument is shown in FIG. 18. The explanation of the measurement is substantially the same as that of the afore-mentioned embodiment, so that it is omitted. In FIG. 18, numeral 40 designates a breast. The elements designated by the same numerals of FIG. 11 are substantially the same as those, so that the explanations of them are omitted.

It is also possible to pull up the top bust to a position where the user desires in the measurement by such an instrument. When the user desires to pull up the top bust to the position shown by the dotted line from the position shown by the real line in FIG. 6, the breast is pulled up by the vertical tape measure 20 of the instrument of the invention, and the value which is designated by the graduation of the vertical tape measure 20 is read. Thus, a size of the cup of brassiere and the like, having the proportion that the user desires, is obtained easily.

The sum of the values of the horizontal length and the vertical length of breast which are measured by the above-mentioned method relatively corresponds to the volume of the cup, and the base line of the cup can be known from the distance between the first and second members 1 and 2 which have respectively the substantially half-circular edge parts 41 and 42. Thus, is is easily be known which cup size will best fit the volume of the breasts of the user.

Figure 19:
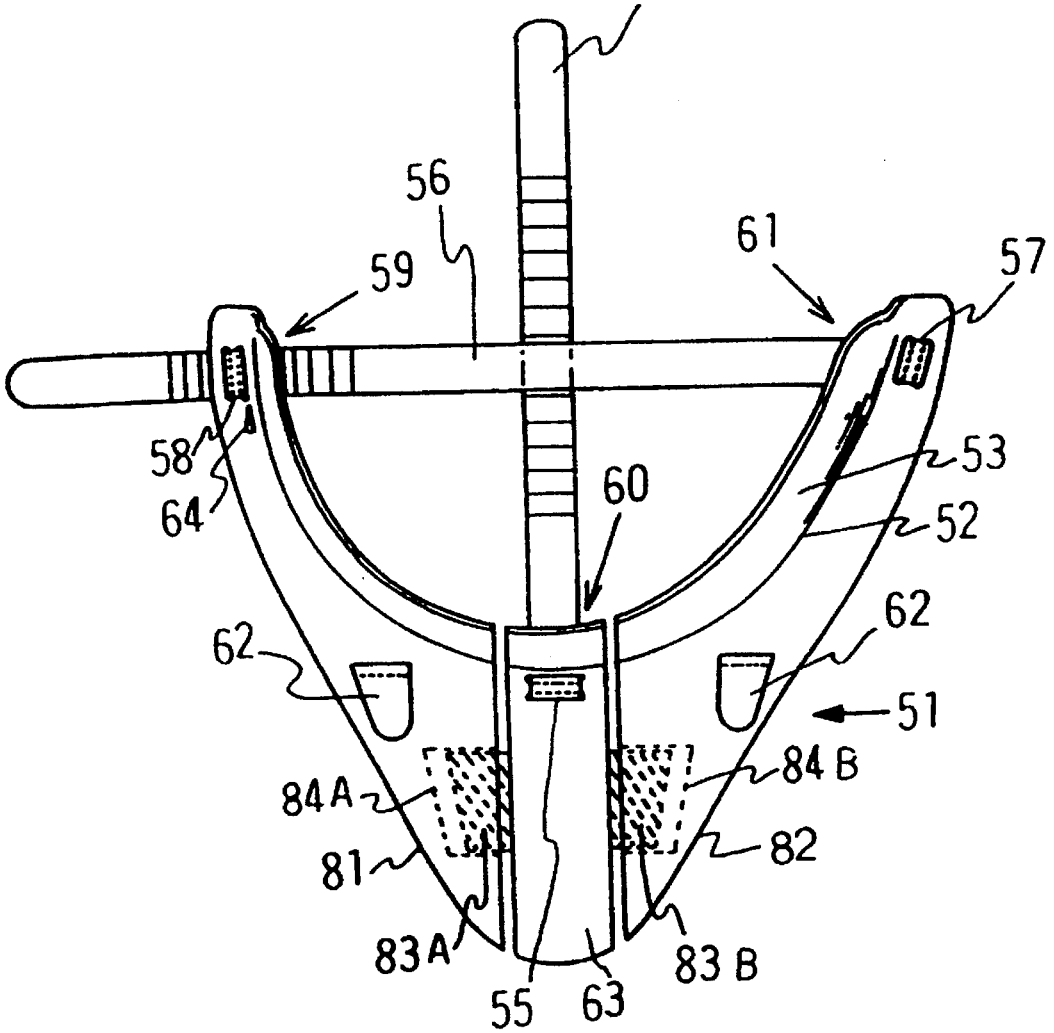
FIG. 19 is a front view of an instrument in accordance with a sixth embodiment of the invention.

A sixth preferred embodiment of the instrument for measuring breast shape in accordance with the invention, which can slide like the embodiment shown in FIG. 11 and has a shape like the embodiment shown in FIG. 1, is described referring to FIG. 19. FIG. 19 is a front view of the instrument in this embodiment. In this embodiment, the base member is separated into three parts. A holder 63 which is positioned at the center of the base member, and first and second members 81 and 82, respectively having substantially one-fourth circular guide surfaces, are positioned at the right and left side of the holder 63, and the first and second members 81 and 82 are slidingly coupled with the holder 63. The first and second members 81 and 82 respectively have guide grooves 84A and 84B which can be slidingly engaged with guide rails 83A and 83B of the holder 63. Thus, the first and second members 81 and 82 are slidingly engaged with the holder 63. The other elements designated by the same numerals in FIG. 1 are substantially the same as those, so that the explanations of them are omitted.

Figure 20:
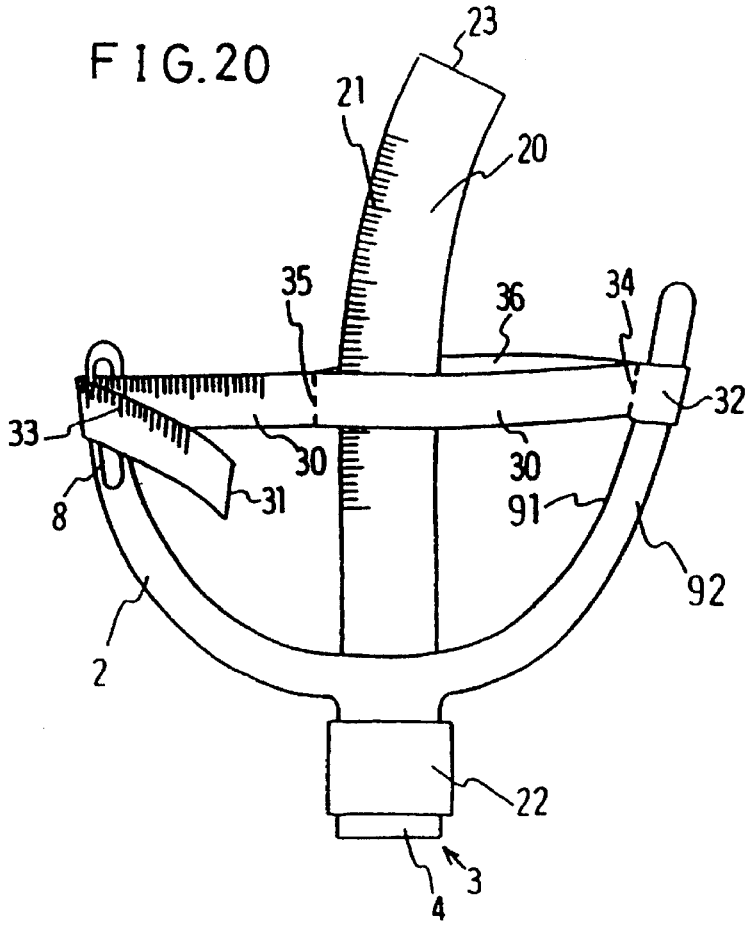
FIG. 20 is a front view showing an instrument in accordance with a seventh embodiment of the invention.

A seventh preferred embodiment of the instrument for measuring breast shape in accordance with the invention, which has a shape like the embodiment shown in FIG. 11 and does not have a sliding mechanism, is described referring to FIG. 20. FIG. 20 is a front view showing the instrument of this embodiment. The different point from the embodiment shown in FIG. 11 is described below. In the embodiment shown in FIG. 11, the base member is formed of three separate pieces, the first member 1 having the substantially one-fourth circular edge part 41, the second member 2 having the substantially one-fourth circular edge part 42 and the holder 3. On the other hand, the base member 92 having a substantially half-circular edge part 92 of this embodiment shown in FIG. 20 is not separated into individual pieces. The other elements designated by the same numerals in FIG. 11 are substantially the same as those, so that the explanations of them are omitted.

The material of the base member in the afore-mentioned embodiments of the invention in not restricted, and any materials can be used as long as they do not damage the object of the invention. For example, polypropylene, polyethylene, polyvinyl chloride, polystyrene, ABS resin, polyamide, polyester, polyurethane resin, epoxy resin, phenol resin, and the other plastic materials, metal, wood, and so on can be used. Of these materials, polypropylene and polyethylene are suitable because they have characteristics of inexpensiveness, light weight and toughness.

The material of the vertical and horizontal tape measures likewise is not restricted, as long as it is flexible, but substantially not stretchable. For example, plastic film or sheet, fabric, such as woven fabric or knitted fabric, metal tape, or combination of them can be used. Especially, in the case of using the plastic material, polyester film, polypropylene film and polyvinyl chloride film are preferable because they can be obtained easily, and are inexpensive, transparent and strong.

In the clothings such as a brassiere and the like which have cups for supporting the breasts, the size of the lower cup part is important. The volume of the lower cup part, which is determined from the sum of the horizontal length and the vertical length of the breast across the bottom area (verg's line of the breast), should correspond to the solid size of the breast.

The upper cup part of the brassiere is generally sewn on or continuous to the lower cup part, and the brassiere design is relatively free with regard to a portion from the size of the over cup part to the chest part. Thus, if the lower cup part is fit to the breasts of the user, the upper cup part can easily be fit to the breast.

On the other hand, there are many types of the cup shape of the clothings, and the cups are not designated by the same standard. For example, in many types of the brassiere such as a type for fully supporting the breasts, a type for pushing the breast to the center of the human body, or a type for pulling up the breasts upwardly, the volume of the breasts will be changed by the function of the brassiere which is to be enhanced, so that the sizes of the cups such as the bottom area, vertical length and the horizontal length of the cup are changed. Thus, it is necessary to confirm the differences by the data or fitting of the clothings, and to prepare a comparison table or a conversion table.

In the brassiere, there are many types, for example, a full cup brassiere with underwire, three-fourth cup brassiere with underwire, one-half cup brassiere with underwire, full cup no underwire brassiere and so on. Accordingly, when the size of the lower cup part is decided, the cup size can also be decided. For deciding the size of the lower cup part, the sizes of the verg's line of the breast, the horizontal length and the vertical length of the breast are important. Even if the verg's lines of the breast are the same, the horizontal length of the breast as well as the vertical length of the breast may vary due to the differences in the volume of the breasts. For instance, a breast with a large volume has greater horizontal length, vertical length and sum of these lengths than a breast with a smaller volume, even if the verg's line of the breast are the same. Therefore, the cup size must be arranged in consideration of the sum of the horizontal and vertical lengths.

On the other hand, even if the breast shapes are different, the shapes of the cups can be the same as long as the verg's line of the breast and the sum of the vertical and horizontal lengths of the breast are identical. For instance, if a nipple is positioned in the center of the breast, the horizontal length of the breast across the nipple is smaller than that of the breast with its nipple positioned at the lower part of the breast and projected more forward the front of the former breast; the length between the nipple and the verg's line of the breast, on the other hand, is larger than that of the latter breast. However, if the latter breast is moved up, the nipple is shifted upward, thus increasing the vertical length, lowering the height of the breast and reducing the horizontal length. In other words, the shape of the latter breast becomes identical to that of the former breast.

If a person whose verg's line of the breast is larger, but the breasts are relatively fiat has the same value of the sum of the horizontal length and the vertical length of breast as that of a person whose verg's line of the breast is smaller than that of the former, but the breast is more protruded, they have respectively different verg's lines of the breast. Thus, they choose different cup sizes.

In case of actually selecting the cup sizes, the design of the cup is a little changed responding to the kinds of the cups, such as full cup, three-fourth cup, one-half cup, and the like. Thus, it is preferable that a cup size table is prepared responding to the verg's line of the breast and the sum value of the horizontal length and vertical length of the breast in each kind of the cup. The user can select one cup size from the table, which is suitable to the breast shape of the user.

A preferred embodiment of the table for the three-fourth type cups is shown in the table 1, which is to be used for the data obtained by using the instrument, for example, shown in FIG. 1. In the table 1, the numeral recited in the upper part of each box designates the sum value of the horizontal length and the vertical length of the breast (unit:cm); the numeral recited in the lower left part of each box designates the vertical length of the breast (unit:cm); and the numeral recited in the lower right part of each box designates the horizontal length of the breast (unit:cm).

The numerals recited in the left column of the table 1 correspond to the size of the base line of the cup, for example, the distance between the front center part 59 to the side part 61 of the circular edge part 52 in FIG. 1. In the table 1, six instruments with different sizes of the base lines are included. In this embodiment, the numeral "0" corresponds to a size of the base line of 9.6 cm; the numeral "1" corresponds to a size of the base line of 10.2 cm; the numeral "2" corresponds to a size of the base line of 10.8 cm; the numeral "3" corresponds to a size of the base line of 11.4 cm; the numeral "4" corresponds to a size of the base line of 12.0 cm; and the numeral "5" corresponds to a size of the base line of 12.6 cm. In the table 1, when the numeral becomes larger from 0 to 5, the size of the base line becomes longer by 0.6 cm.

TABLE 1

| No. | P | Q | R | S | T |
|---|---|---|---|---|---|
| 0 | 21.0<br>6.4;14.6 | | | | |
| 1 | 22.9<br>7.0;15.9 | 22.2<br>6.8;15.4 | | | |
| 2 | 25.2<br>7.8;17.4 | 24.1<br>7.4;16.7 | 23.4<br>7.2;16.2 | | |
| 3 | 27.5<br>8.6;18.9 | 26.4<br>8.2;18.2 | 25.3<br>7.8;17.5 | 24.6<br>7.6;17.0 | |
| 4 | 30.3<br>9.8;20.5 | 28.7<br>9.0;19.7 | 27.6<br>8.6;19.0 | 26.5<br>8.2;18.3 | 25.8<br>8.0;17.8 |
| 5 | 33.1<br>10.7;22.4 | 31.5<br>10.2;21.3 | 29.9<br>9.2;20.5 | 28.8<br>9.0;19.8 | 27.7<br>8.6;19.1 |

For example, assume that the horizontal length and the vertical length of the breast of the user are measured by the instrument having the size of the verg's line of the breast corresponding to the numeral "4", and the sum of the measured values of the horizontal length and the vertical length of the breast is 27.3 cm. The column designated by the numeral "4" is searched from left to right, and a value of 27.6 cm, which is the nearest value to the sum of the measured data of 27.3 cm, is found below the column "R". As a result, a cup having the size corresponding to 4-R should be selected. The cup corresponding to 4-R has the same base line as that of the instrument corresponding to the numeral "4", in which the vertical length of the breast is 8.6 cm and the horizontal length of the breast is 19.0 cm. These values are previously decided by responding to the data obtained from a lot of monitors.

In the above-mentioned table 1, the sum of the horizontal length and the vertical length of the breast becomes larger by 1.2 cm from upper left to lower right. Similarly, the cup size becomes larger by 1.2 cm and the horizontal length becomes larger by 0.8 cm.

The table 1 shows an embodiment and the data are not restricted by this embodiment. The terms used in the above-mentioned embodiments are as described previously.

Figure 21:
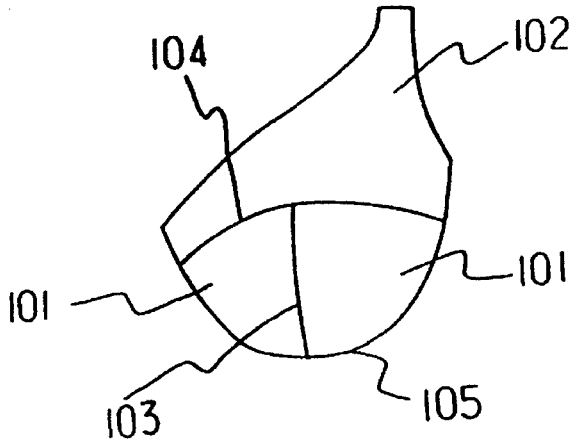
FIG. 21 is a perspective view showing an embodiment of a three-fourth cup brassiere.

FIG. 21 is a perspective view showing a cup of the three-fourth type for a brassiere. Numeral 101 designates the lower cup; numeral 102 designates the upper cup; numeral 103 designates the vertical length of the lower cup; numeral 104 designates the horizontal length of the lower cup; and numeral 105 designates the base line of the cup.

As mentioned above, in clothing such as a brassiere having cups for supporting the breasts, the volume of the lower cup is especially important. When the size of the lower cup is decided, the size and inclination of the upper cup are inevitably decided in response to the type of the clothing, without considering the individual differences, since the upper cup is serially formed or sewn to the lower cup. The types are, for example, full cup, three-fourth cup. one-half cup. full cup no underwire type and the like. The chest part of the products (upper cup part) are made relatively free, so that the chest part can follow the individual differences of the sizes of the breasts.

From the afore-mentioned description, it is known that the sum of the horizontal length and vertical length of the breast and the size of the base line of the breast correspond to the volume of the cups. Furthermore, when these sizes can be obtained, it becomes easy to select the cup size which is suitable to the user's taste. Thus, the instrument in accordance with the invention is very useful to precisely measure the horizontal length and the vertical length of the breast and to select the base line of the cup.

The inventors have tested the design of the cup and the fitting feeling of the brassiere with 62 women with using the present instrument for measuring the horizontal length and the vertical length of the breast. As a result, 81% out of the tested women have answered comfortable with respect to fitting without gaps or the creases from the larger cups, or bulging out of the breast from the smaller cups. That is, the brassiere having the cup sizes that the user desires can be provided with a high probability.

The invention may be embodied in other specific forms without departing from the spirit and scope thereof. The embodiments are to be considered in all respects as illustrative and not restrictive. The scope of the invention is indicated by the appended claims rather than by the forgoing description, and all changes which come within the meaning and range of equivalency of the claims are intended to be embraced therein.

What is claimed is:

1. An instrument for measuring breast shape comprising:

a base member having first and second free ends which are joined by a substantially half-circular edge part which is to be applied along a verg's line of a breast which is a circular arc underneath each breast;

a vertical tape measure having a predetermined graduation for measuring a vertical length of the breast between a nipple and a verg's line of the breast, having a first end which is fixed on the base member at a position in the vicinity of a lowest position of the substantially half-circular edge part;

a horizontal tape measure having a predetermined graduation for measuring a horizontal length of the breast across the nipple, having a first end which is fixed on the base member at a position in the vicinity of one of the first and second free ends of the base member.

2. The instrument for measuring breast shape in accordance with claim 1, wherein the horizontal tape measure has a free second end, the instrument further comprising:

a slit, into which the free second end of the horizontal tape measure can be put, which is provided on the base member at a position in the vicinity of the other of the first and second free ends of the base member.

3. The instrument for measuring breast shape in accordance with claim 1, further comprising:

at least one guide hook on the base member at a position below the substantially half-circular edge part, by which the base member can be hooked on a tape or a string to be wound around an under bust part of a human body.

4. The instrument for measuring breast shape in accordance with claim 1, further comprising:

a stopper, which has a width a little larger than a width of the horizontal tape measure, provided on the base member at a position where the horizontal tape measure is to be fixed, for restricting movement of the horizontal tape measure.

5. The instrument for measuring breast shape in accordance with claim 1, wherein the horizontal measuring tape has a free end, the instrument further comprising:

a supplemental tape having first and second ends fixed to the horizontal tape measure, extending between a point in the vicinity of the fixed end of the horizontal measuring tape and a point near the center of a line between the first and second free ends of the base member but on the side of the free ends of the horizontal measuring tape with respect to said center, the supplemental tape and the horizontal measuring tape forming a loop for accepting a free end of the vertical tape measure.

6. The instrument for measuring breast shape in accordance with claim 1, further comprising:

a stopper for preventing movement of the fixed end of the vertical tape measure, provided on the tape fixing part of the base member.

7. An instrument for measuring breast shape comprising:

a base member having a first member with a first substantially one-fourth circular edge part and a second member with a second substantially one-fourth circular edge part; the first and second members each having a first end which is slidably connected to a supporting member and a free second end; the first and second substantially one-fourth circular edge part forming a substantially half-circular edge part which is to be applied along a verg's line of a breast which is a circular arc underneath each breast;

a vertical tape measure having a predetermined graduation for measuring a vertical length of the breast between a nipple and a verg's line of the breast, having a first end which is fixed on the base member at a position in the vicinity of a lowest position of the substantially half-circular edge part; and a horizontal tape measure having a predetermined graduation for measuring horizontal length of breast across the nipple, having a first end which is fixed on the base member at a position in the vicinity of one of the free second ends of the first and second members.

8. The instrument for measuring breast shape in accordance with claim 7, wherein the horizontal tape measure has a free second end, the instrument further comprising:

a slit, into which the free second end of the horizontal tape measure can be put, which is provided on the base member a position in the vicinity of the other of the free second ends of the first and second members.

9. The instrument for measuring breast shape in accordance with claim 7, further comprising:

at least one guide hook on the base member at a position below the substantially half-circular edge part, by which the base member can be hooked on a tape or a string to be wound around an under bust part of a human body.

10. The instrument for measuring breast shape in accordance with claim 7, wherein a stopper, which has a width a little larger than a width of the horizontal tape measure, provided on the base member at a position where the horizontal tape measure is to be fixed, for restricting movement of the horizontal tape measure.

11. The instrument for measuring breast shape in accordance with claim 7, wherein the horizontal measuring tape has a free end, the instrument further comprising:

a supplemental tape having first and second ends fixed to the horizontal tape measure, extending between a point in the vicinity of the fixed end of the horizontal measuring tape and a point near the center of a line between the free second ends of the first and second members but on the side of the free ends of the horizontal measuring tape with respect to said center, the supplemental tape and the horizontal measuring tape forming a loop for accepting a free end of the vertical tape measure.

12. The instrument for measuring breast shape in accordance with claim 7, further comprising:

a stopper for preventing movement of the fixed end of the vertical tape measure, provided on the tape fixing part of the base member.

13. An instrument for measuring breast shape comprising:

a base member having a first member with a first substantially one-fourth circular edge part, a second member with a second substantially one-fourth circular edge part and a holder for connecting the first and second members, the first and second substantially one-fourth circular edge part forming a substantially half-circular edge part which is to be applied along a verg's line of a breast which is a circular arc underneath each breast; the holder having a pair of guide rails horizontally protruded therefrom; and the first and second members each having a first end which is provided with a guide groove to be engaged with one of the guide rails and a free second end;

a vertical tape measure having a predetermined graduation for measuring a vertical length of the breast between a nipple and a verg's line of the breast, having a first end which is fixed on the base member at a position in the vicinity of a lowest position of the substantially half-circular edge part;

a horizontal tape measure having a predetermined graduation for measuring a horizontal length of breast across the nipple, having a first end which is fixed on the base member at a position in the vicinity of one of the free second ends of the first and second members.

14. The instrument for measuring breast shape in accordance with claim 13, wherein at least one convex stopper is provided on a surface of each of the guide rails, and at least one convex stopper is provided on a surface of each of the guide grooves.

15. The instrument for measuring breast shape in accordance with claim 13, wherein the horizontal tape measure has a free second end, the instrument further comprising:

a slit, into which the free second end of the horizontal tape measure can be put, which is provided on the base member at a position in the vicinity of the other of the free second ends of the first and second members.

16. The instrument for measuring breast shape in accordance with claim 13, further comprising:

at least one guide hook on the base member at a position below the substantially half-circular edge part, by which the base member is to be hooked on a tape or a string to be wound around an under bust part of a human body.

17. The instrument for measuring breast shape in accordance with claim 13, further comprising:

a stopper means, which has a width a little larger than a width of the horizontal tape measure, is provided on the base member at a position where the horizontal tape measure is to be fixed for restricting movement of the horizontal tape measure.

18. The instrument for measuring breast shape in accordance with claim 13, wherein the horizontal measuring tape has a free end, the instrument further comprising:

a supplemental tape having first and second ends fixed to the horizontal tape measure, extending between a point in the vicinity of the fixed end of the horizontal measuring tape and a point near the center of a line between the free second ends of the first and second members but on the side of the free ends of the horizontal measuring tape with respect to said center, the supplemental tape and the horizontal measuring tape forming a loop for accepting a free end of the vertical tape measure.

19. The instrument for measuring breast shape in accordance with claim 13, further comprising:

a stopper for preventing movement of the fixed end of the vertical tape measure, provided on the tape fixing part of the base member.

* * * * *